US005234500A

United States Patent [19]

Korokeyi

[11] Patent Number: 5,234,500

[45] Date of Patent: Aug. 10, 1993

[54] LIQUID DISTRIBUTION SYSTEM FOR PHOTOGRAPHIC COATING DEVICE

[75] Inventor: Solomon T. Korokeyi, Rochester, N.Y.

[73] Assignee: Eastman Kodak Company, Rochester, N.Y.

[21] Appl. No.: 766,945

[22] Filed: Sep. 27, 1991

[51] Int. Cl.[5] ..... B05C 5/00

[52] U.S. Cl. ..... 118/325; 118/DIG. 4

[58] Field of Search ..... 366/336; 118/325, DIG. 4; 427/402, 420

[56] References Cited

U.S. PATENT DOCUMENTS

| | | |
|---|---|---|
| 2,761,417 | 2/1955 | Russell et al. . |
| 3,005,440 | 10/1961 | Padday . |
| 3,384,925 | 5/1968 | Rothemeyer . |
| 3,611,492 | 10/1971 | Scheibling . |
| 3,761,211 | 9/1973 | Parkinson . |
| 3,825,645 | 7/1974 | Fayet . |
| 4,041,897 | 8/1977 | Ade . |
| 4,109,611 | 8/1978 | Fahrni et al. . |
| 4,142,010 | 2/1979 | Pipkin et al. . |
| 4,152,387 | 5/1979 | Cloeren . |
| 4,285,655 | 8/1981 | Matsubara . |
| 4,287,240 | 9/1981 | O'Connor . |
| 4,389,181 | 6/1983 | Frick . |
| 4,522,776 | 6/1985 | Ramamurthy . |
| 4,536,362 | 8/1985 | Donaldson . |
| 4,690,628 | 9/1987 | Dehennau et al. . |
| 4,731,213 | 3/1988 | Klepsch . |
| 4,789,511 | 12/1988 | Bilgin . |
| 5,143,758 | 9/1992 | Devine ..... 118/DIG. 4 |

FOREIGN PATENT DOCUMENTS

| | | |
|---|---|---|
| 12804/71 | 10/1972 | Switzerland . |
| 1389074 | 4/1975 | United Kingdom . |

OTHER PUBLICATIONS

K. Lee, et al. "Vortex Formation in A Dual-Cavity Coat-Hanger Die", *Polymer Engineering & Science*, vol. 30, No. 19, pp. 1220-1227 (mid-Oct. 1990).

K. Lee and T. Liu, "Design and Analysis of a Dual-Cavity Coat Hanger Die," *Polymer Engineering and Science*, vol. 29, No. 15 (mid-Aug. 1989).

*Primary Examiner*—W. Gary Jones
*Assistant Examiner*—Charles K. Friedman
*Attorney, Agent, or Firm*—Nixon, Hargrave, Devans & Doyle

[57] ABSTRACT

The present invention relates to a fluid conditioning system having a primary distribution channel configured to distribute coating fluid transversely. Fluid from the primary distribution channel is carried by a second conduit to a secondary distribution channel which is configured to minimize transverse pressure gradients in fluids having Reynolds Numbers of up to 50 without substantial formation of eddies. A product conduit withdraws liquid from the secondary distribution channel. This fluid conditioning system is particularly useful in applying photographic liquids to a web of photographic film or paper. For this utility, the system can be incorporated in a conventional slide hopper between adjacent layering plates or the liquid-applying plate and its adjacent layering plate.

21 Claims, 5 Drawing Sheets

LIQUID DISTRIBUTION SYSTEM FOR PHOTOGRAPHIC COATING DEVICE

FIELD OF THE INVENTION

The present invention relates to a device for applying liquid photographic coatings to a paper or film support.

BACKGROUND OF THE INVENTION

In producing photographic film or paper, it is necessary to coat the film support or paper with discrete layers of photographic coatings. Some of these layers contain a radiation sensitive material like silver halides, zinc oxide, titanium dioxide, diazonium salts, and light sensitive dyes as well as other photographic additives including matting agents, developing agents, mordants, etc. Other layers may contain materials which are not radiation sensitive like subbing layers, pelloid protective layers, filter layers, antihalation layers, and interlayers. Additionally, hydrophilic colloids, polysaccharides, surfactants and synthetic polymers may also be incorporated in photographic coating liquids.

The number of separate and discrete layers of photographic coatings applied to photographic paper or film support depends on the product's design. Typically, the number of layers varies between 1 to 15, more usually 3 to 13.

A multi-slide hopper is a known apparatus which will simultaneously coat two or more liquids onto a solid support in such a way that the layers are not mixed and are individually of uniform thickness. The conventional slide hopper performs its coating operation by metering a first coating liquid from a supply through a narrow slot which distributes the liquid uniformly across the top of a downwardly inclined slide surface. This layer of liquid moves down the slide surface by gravity to supply a steady, uniform, smooth coating layer to a coating bead across which it is applied to the web being coated. A second coating liquid is supplied to and distributed by, a second slot which directs a uniform layer of that liquid onto the top of a second slide surface. The second coating liquid first flows down its own slide surface and then onto the top of the layer of liquid issuing from the first slot. The layers of the first and the second liquids then together flow down to a coating bead where they are applied to the web. Additional liquids may be coated simultaneously by equipping the hopper with the appropriate number of slots and slide surfaces.

Instead of applying photographic coatings from a multi-slide hopper to a web by use of a coating bead, multi-layer photographic coatings can be applied by passing the web beneath a liquid curtain formed by discharging the coating liquid from a terminal lip portion of the multi-slide hopper. Both the bead coating and curtain coating techniques are well known, as disclosed e.g., in U.S. Pat. No. 4,287,240 to O'Connor.

Photographic liquids are generally pumped from a supply to a slot at the hopper's slide surface through passages in the coating hopper. To dampen flow surges and achieve thickness uniformity in the applied coatings, the passages include one or more transverse distribution channels. Such distribution channels receive photographic liquid from a relatively narrow feed conduit and spread it transversely so that it forms a liquid layer distributed across the bopper width when discharged from the slot. Distribution occurs due to the hopper's low resistance to transverse liquid flow and its high resistance to longitudinal flow toward the slot. These distribution channels have been formed with a variety of cross-sectional configurations, including circular shapes (see, e.g.. U.S. Pat. No. 4,041,897 to Ade), semi-circular shapes (see, e.g.. U.S. Pat. No. 4,109,611 to Fahrni et al.), and triangular shapes (see, e.g., U.S. Pat. No. 3,005,440 to Padday). Generally, such configurations have the same cross-sectional shape at all locations across the hopper. However, distribution channels can also be designed to narrow as they extend transversely outward within the hopper (see e.g. Swiss Patent No. 530,032 to Ciba-Geigy AG).

When a single distribution channel is utilized, product non-uniformities can occur due to imperfect channel fabrication as well as deviations from flow rates, viscosities, temperatures, and pressures of the coating liquid for which the channel was designed. To counteract these problems, it has been found advantageous to place a secondary distribution channel in the photographic liquid passages of the hopper downstream of the primary distribution channel. Like the primary distribution channel, the secondary distribution channel is configured to impose a low resistance to transverse liquid flow and a high resistance to longitudinal liquid flow toward the slot exit. As a result, any transverse pressure non-uniformities in liquid emerging from the primary distribution channel are substantially reduced. See Swiss Patent No. 530,032 to Ciba-Geigy AG, British Patent No. 1,389,074 to GAF Corporation, and K. Lee and T. Liu, "Design and Analysis of a Dual-Cavity Coat Hanger Die," *Polymer Engineering and Science. vol.* 29, no. 15 (mid-August 1989), which discloses the use of two distribution channels generally.

In polymer extrusion, where secondary distribution channels have also been utilized, the cross-sectional shape of that channel is not critical due to the narrow range of solution properties and process conditions encountered. These properties and conditions are generally defined in terms of a Reynolds Number which is defined as follows:

$$Re = \frac{\rho q}{\mu}$$

where:

$\rho$ is the fluid density $\mu$ is the fluid viscosity q is the flow rate per unit width (i.e. the flow rate at the secondary distribution channel inlet divided by width of the hopper perpendicular to the channel cross-section).

For polymer extrusion, the Reynolds Number is generally about zero because of very high fluid viscosity. With such a low Reynolds Number, the primary function of the secondary distribution channel becomes merely the reduction of non-uniformity in fluid distribution resulting from imperfect hopper manufacture. However, when moderate Newtonian viscosity and/or high flow rates are encountered, as in the coating of photographic materials, such non-uniformity is more likely to occur due to variations in fluid parameters rather than imperfect hopper design. To ameliorate such non-uniformity, the cross-sectional area of the secondary distribution channel should be increased. This creates additional problems, however, including the onset of flow recirculation (i.e. eddying) within the secondary distribution channel, and sedimentation of solids in the liquid.

FIGS. 2A to D show fluid flow in a side cross-sectional view of a secondary distribution channel with a commonly-used semi-circular shape at Reynolds Numbers of 0, 10, 12, and 20, respectively. This configuration is semi-circular in that the center of the circle lies in the plane of slot-forming wall 200 of hopper plate 202. In each of these figures, fluid traveling along the path defined by arrow F enters the channel and travels along the depicted paths. As the Reynolds Number is increased from a very low value (i.e. Re=0) to Re=20, we see smooth flow for FIG. 2A, the onset of separation from channel wall 204 at the entrance to the channel in FIG. 2B, a developed eddy in FIG. 2C, and, finally, a full eddy encompassing a large portion of the channel in FIG. 2D. It is thus apparent that in prior art designs of secondary distribution channels a substantial growth in the size of an eddy takes place as the Reynolds Number increases.

For photographic coatings, it is believed that eddies in the secondary distribution channel may entrap foreign materials in the coating solution during purge flow conditions (i.e., at high Reynolds Numbers used to remove flush water and/or air from the channel). These materials may then be released into the flow stream at coating conditions (i.e., at lower Reynolds Numbers) and may re-lodge on the walls of the hopper downstream of the eddying region (e.g., at the slot for that liquid, on the slide, or on the coating lip). This can generate streaks in the product which is unacceptable for high quality products. As a result, the hopper must be periodically shut down and purged to remove particles. This procedure increases waste and diminishes product output.

Eddies in the flow field during coating are also known to increase dramatically the residence time of that portion of the solution caught in the recirculating zone. In photographic liquids with time dependent chemical reactions, this may cause the resulting product to have a more non-uniform composition which does not meet specifications.

In recognition of these problems, hopper designers have taken a number of approaches to eliminate or reduce the presence of eddies in the flow field. For example, the configuration of the secondary distribution channel has been changed from a semi-circular shape to a shorter circular segment. FIGS. 3A to D show fluid flow in a side cross-sectional view of a secondary distribution channel with a circular segment shape at Reynolds Numbers of 0, 15, 18, and 20, respectively. This segment is less than 180° so that the center of a full circle containing this segment lies within hopper plate 302 somewhat distal from slot-forming wall 300. These drawings show no eddy at a Reynolds Number of 0 (FIG. 3A). As the Reynolds Number is increased to 15, a minor eddy develops (FIG. 3B). Major eddying and a yet larger eddy appear at Reynolds Numbers of 18 and 20, respectively, as shown in FIGS. 3C and 3D, respectively.

A comparison of FIGS. 3A to D with FIGS. 2A to D shows that the onset of flow recirculation is postponed to a higher Reynolds number with the circular segment configuration of FIGS. 3A to D. However, the use of a circular segment configuration achieves only a modest delay of eddying and reduces the cross-sectional area of the secondary distribution channel, which, in turn, diminishes its ability to reduce non-uniformities. As a result, the need for a properly configured secondary distribution channel continues to exist.

SUMMARY OF THE INVENTION

The present invention relates to a fluid conditioning system, particularly useful in conjunction with a coating hopper for applying photographic liquid coatings on a web of paper or film. This system includes both primary and secondary distribution channels with an interconnecting transverse slot between them, a conduit for feeding liquid to the primary distribution channel, and a transverse slot for removing liquid from the secondary distribution channel. The secondary distribution channel is configured to delay eddy formation to a Reynolds Number above that at which eddies would normally form in secondary distribution channels of different configuration, while maintaining a relatively large cross-sectional area. Generally, the secondary distribution channel is able to produce a transversely uniform pressure in the coating liquid without formation of significant eddies at Reynolds Numbers up to 50. This is achieved by configuring the secondary distribution channel to be deeper near its exit than near its entrance by providing it with an inlet expansion angle less than the exit contraction angle of the channel.

In photographic curtain coating hoppers, the fluid conditioning system is formed between adjacent layering plates or between the curtain-forming plate and its adjacent layering plate. This system supplies photographic liquids to the inclined slide surface of the hopper so that a pack of discrete liquid layers may be formed. This pack is then applied to a web of photographic film or paper as a curtain. The present invention is also useful in conjunction with a coating hopper which operates by the bead coating principle.

DETAILED DESCRIPTION OF THE DRAWINGS

Figure 1:
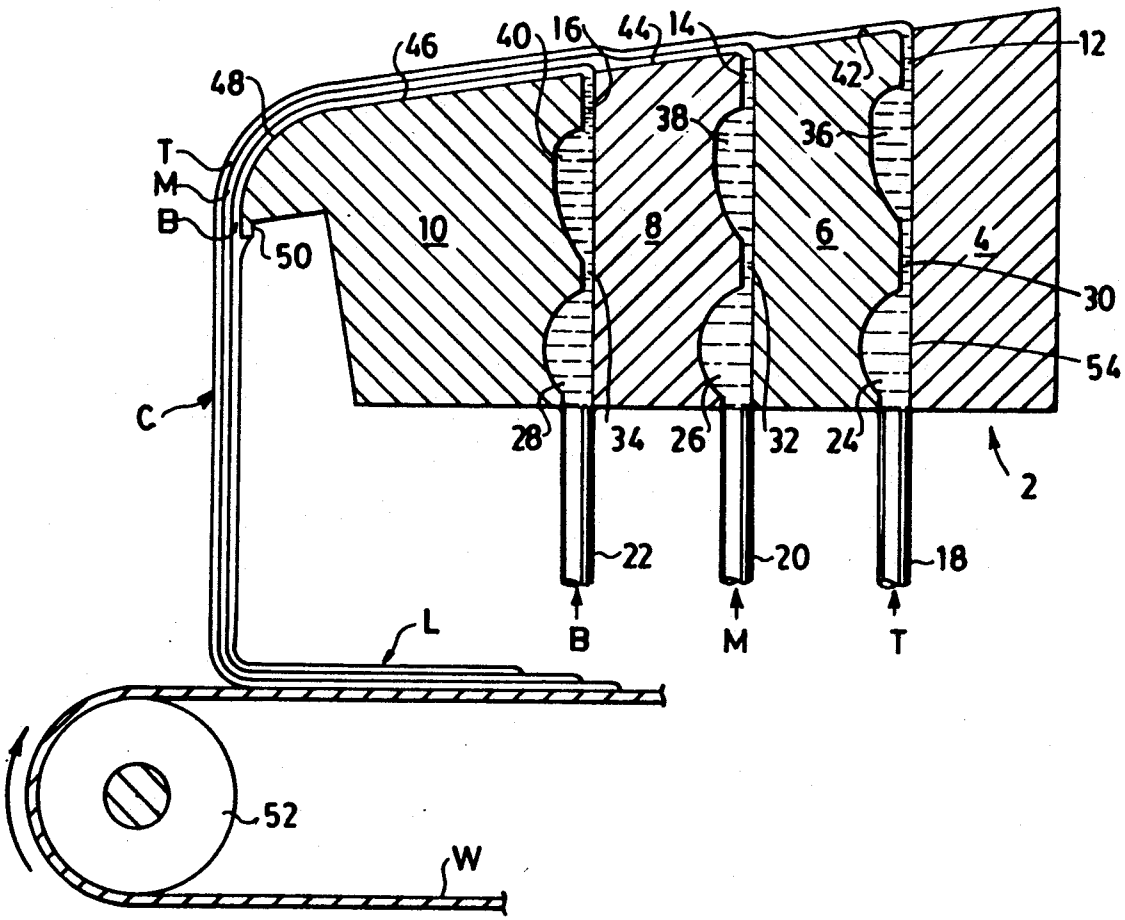
FIG. 1 is a side cross-sectional view of a curtain coating slide hopper in accordance with the present invention.
Figure 2A:
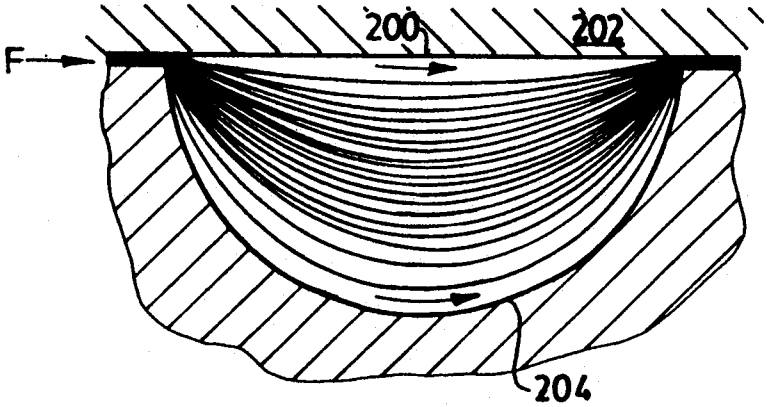
FIGS. 2A, 2B, 2C, and 2D show fluid flow for side cross-sectional views of a secondary distribution channel having a semi-circular configuration at Reynolds numbers of 0, 10, 12, and 20, respectively.
Figure 2B:
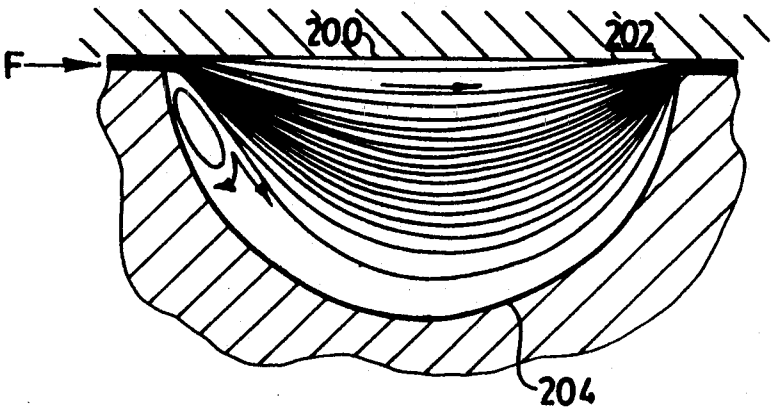
Figure 2C:
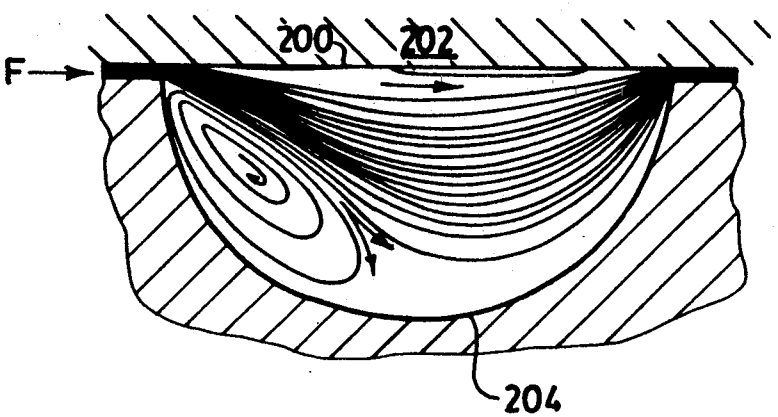
Figure 2D:
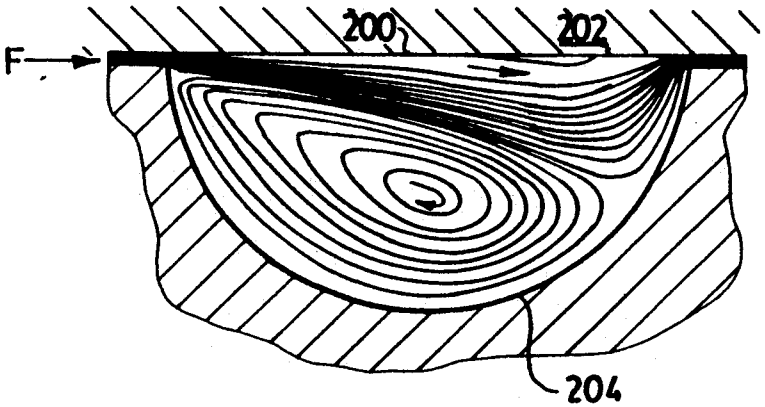
Figure 3D:
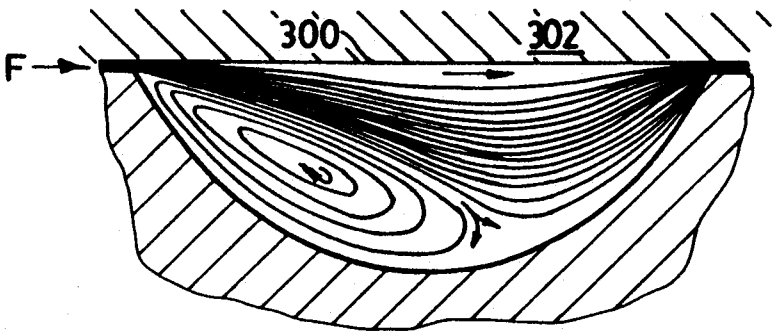
FIGS. 3A, 3B, 3C, and 3D show fluid flow for side cross-sectional views of a secondary distribution channel having a circular segment configuration at Reynolds Numbers of 0, 15, 18, and 20, respectively.
Figure 3C:
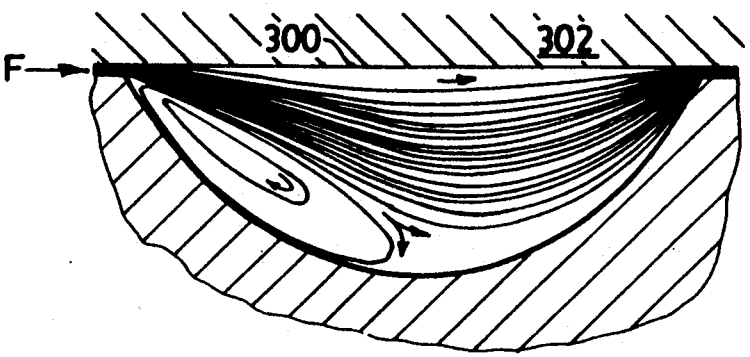
Figure 3A:
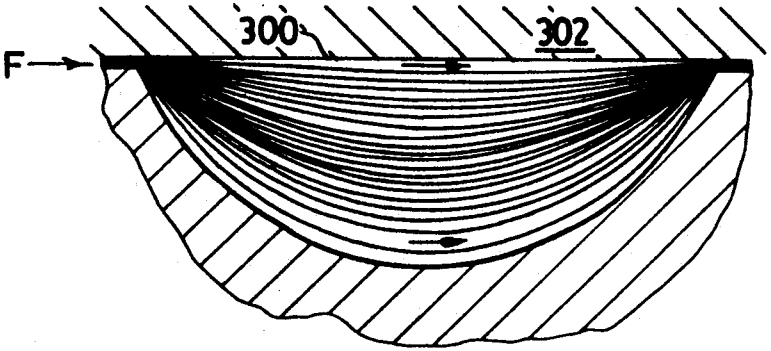
Figure 3B:
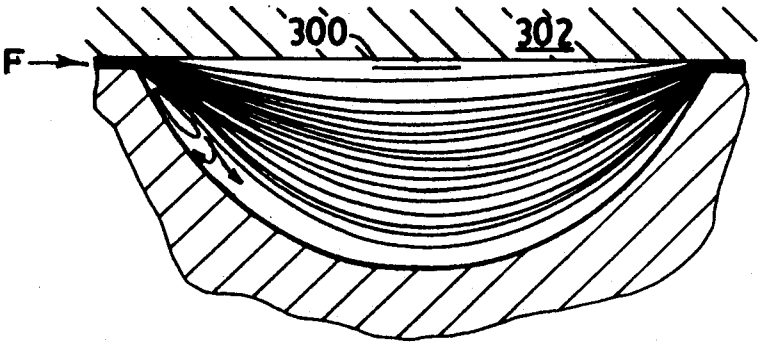

FIG. 1 is a side cross-sectional view of a photographic liquid coating slide hopper 2 in accordance with the present invention. Slide hopper 2 includes layering plates 4, 6, and 8 and curtain-forming plate 10. Layering plates 6 and 8 and curtain-forming plate 10 have upper planar surfaces 42, 44, and 46, respectively, which together form a wide incline at an angle of from 5 to 20 degrees, preferably 15 degrees, from horizontal.

Protruding from the end of curtain-forming plate 10 which is distal from the layering plates is vertical lip 50.

The spaces between layering plates 4, 6, and 8 and between layering plate 8 and curtain-forming plate 10 form passages for supplying photographic liquids to the incline formed by upper planar surfaces 42, 44, and 46. For top liquid T, this passage, which extends transversely to hopper side 2 (i.e. into and out of FIG. 1), is defined by the space between layering Plates 4 and 6 and includes primary distribution channel 24, intermediate passage 30, secondary distribution channel 36, and slot 12, all of which extend transversely across hopper 2. Liquid T is fed to primary distribution channel 24 by feed conduit 18 which has a central or side location relative to the transverse extent of channel 24 across the width of hopper 2. As to middle liquid M, the space between layering plates 6 and 8, defined by primary distribution channel 26, intermediate passage 32, secondary distribution channel 38, and slot 14, all of which extend transversely across hopper 2, constitutes the passage. Liquid M is supplied to primary distribution channel 26 by feed conduit 20 which is located centrally or at the end of the transverse extent of channel 26. Bottom liquid B's passage is between layering plate 8 and curtain-forming plate 10 and includes primary distribution channel 28, intermediate passage 34, secondary distribution channel 40, and slot 16, all extending transversely across hopper 2. Feed conduit 22 supplies liquid B to primary distribution channel 28 and has a central or side location with respect to the transverse extent of channel 28 across the width of hopper 2. For liquids T, M, and B, the primary and secondary distribution channels reduce the resistance to transverse flow of liquid across hopper 2, while a high resistance to longitudinal flow is maintained by the intermediate passages and slots, respectively. As a result, liquid layers flowing onto the incline defined by planar surfaces 42, 44, and 46 are spread to a suitable width and have a high level of uniformity due to the substantial reduction in pressure variation achieved by the distribution channels.

As is apparent from FIG. 1, top liquid T is discharged from slot 12 onto planar surface 42. In turn, middle liquid M is deposited on and in contact with planar surface 44 beneath top liquid T. Likewise, bottom liquid B is deposited on and in contact with planar surface 46 of curtain-forming plate 10 beneath middle liquid M and top liquid T. Once applied to the incline defined by the upper planar surfaces of layering plates 4, 6, and 8 and curtain-forming plate 10, liquids B, M, and T maintain their identity as separate and discrete layers.

The separate and discrete layers of liquids B, M, and T flow down planar surface 46, around transition section 48 and fall from lip 50 as a curtain C of liquid coating onto web W as layer L. Web W is transported into contact with the curtain C by drive roller 52.

Although FIG. 1 depicts primary distribution channels 24, 26, and 28 as having a semi-circular configuration, these channels can also have any configuration conventionally used for primary distribution channels, including circular, semi-circular, circular segment, rectangular, and triangular shapes. It should also be noted that surface 54 of layering plate 4 which defines in-part primary distribution channel 24, intermediate passage 30, secondary distribution channel 36, and slot 12 can be substantially planar. This is likewise true for the fluid passage systems for middle liquid M and bottom liquid B with respect to layering plates 6 and 8, respectively.

In operation, top liquid T is fed through feed conduit 18, primary distribution channel 24, intermediate passage 30, secondary distribution channel 36, and slot 12 to planar surface 42 of layering plate 6. Middle liquid M is conveyed through feed conduit 20, primary distribution channel 26, intermediate passage 32, secondary distribution channel 38, and slot 14 and is brought into contact with planar surface 44 beneath the layer of top liquid T. Bottom liquid B is charged through feed conduit 22, primary distribution channel 28, intermediate passage 34, secondary distribution channel 40, and slot 16 into contact with planar surface 46. The layer formed by liquid B is positioned below the separate and discrete layers formed by liquids T and M. The aggregate of layered liquids T, M, and B advances downwardly along planar surface 46, transition section 48, and lip 50 without substantial interlayer mixing. From lip 50, these liquid layers fall as a continuous curtain C onto web W and in the form of layer L. Web W is advanced past the point it is impinged by curtain C by drive roller 52. After layer L is applied to web W, layer L is dried on web W either by ambient conditions or by forced air drying.

As shown in FIG. 1, the secondary distribution channel configured in accordance with the present invention can be incorporated into a multiple-slide hopper used in curtain coating. Alternatively, this secondary distribution channel configuration can be utilized in conjunction with other systems for coating photographic liquids on webs of photographic film or paper. For example, the secondary distribution channel of the present invention can be utilized in conjunction with a bead coating hopper, having one or more multiple slides.

FIGS. 4A to D show fluid flow for side cross-sectional views of secondary distribution channel 36 of FIG. 1, having a configuration in accordance with the present invention at Reynolds Numbers of 0, 30, 35, and 40, respectively. Secondary distribution channels 38 and 40 of FIG. 1 should be similarly configured. Note that the cross-section in FIG. 1 is viewed from the opposite direction of those FIGS. 4A to D.

As shown in FIGS. 4A to D, fluid enters the secondary distribution channels along the path defined by arrow F. The second distribution channel of the present invention has an inlet expansion angle $\Theta$ which is less than the outlet contraction angle $\phi$. Generally, the inlet expansion angle should be 10 to 80 degrees, more preferably 25 to 35 degrees. The outlet contraction angle is usually 40 to 90 degrees, more preferably 80 to 90 degrees. As shown in FIGS. 4A to D, the secondary distribution channel is defined by inlet expansion surface 402, outlet contraction surface 404, and transition surface 406 which substantially connects surfaces 402 and 404 and defines the deepest portion of the secondary distribution channel. Inlet expansion angle $\Theta$ is defined by planar surface 54 and a line tangential to inlet expansion surface 402, while outlet contraction angle $\phi$ is defined by planar surface 54 and a line tangential to outlet contraction surface 404. FIGS. 4A to D show the tangential lines to inlet expansion surface 402 and outlet contraction surface 404 being very close to where the secondary distribution channel begins and ends, respectively. However, the requirement that the inlet expansion angle be less than the outlet contraction angle should be true for the $\Theta$ and $\phi$ values defined by all lines tangential to surfaces 402 and 404, respectively, which extend to the deepest portion of the secondary distribution channel—transition surface 406.

Transition surface 406 is substantially parallel to the opposite planar surface 54 which is the lefthand most edge of layering plate 4 in FIG. 1. Planar surface 54 also defines one surface of primary distribution channel 24, intermediate passage 30, and slot 12 for the passages carrying liquid T. The distribution systems for liquids B and M in FIG. 1 may be similarly configured.

Figure 4A:
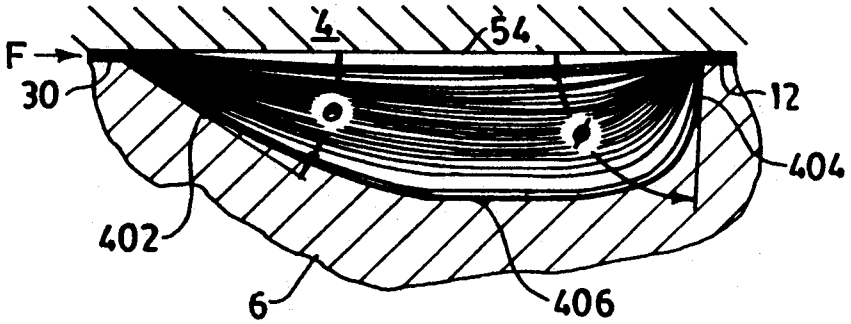
FIGS. 4A, 4B, 4C, and 4D show fluid flow for side cross-sectional views of secondary distribution channel 36 of FIG. 1, having a configuration in accordance with the present invention, at Reynolds Numbers of 0, 30, 35, and 40, respectively.
Figure 4B:
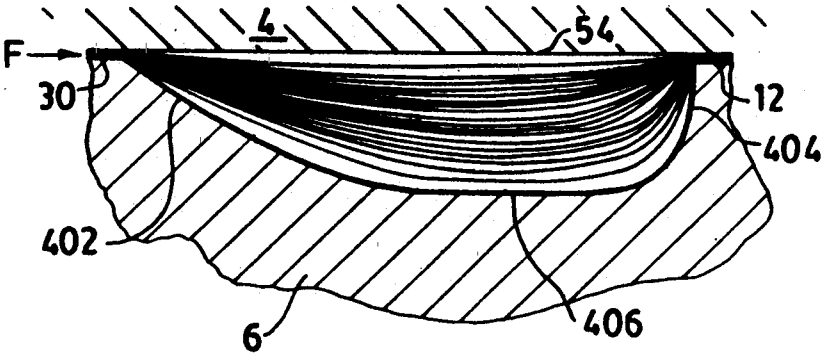
Figure 4C:
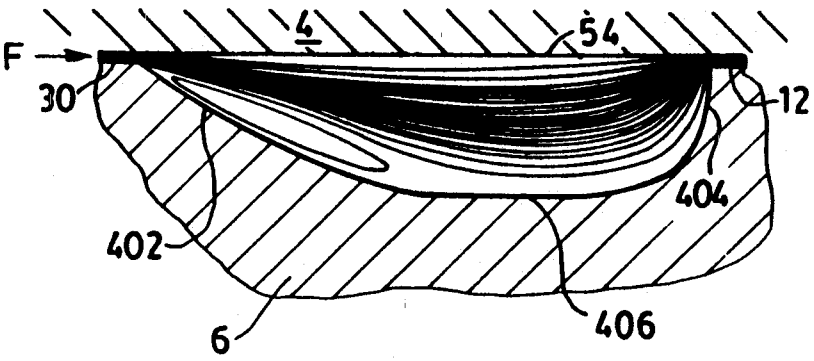
Figure 4D:
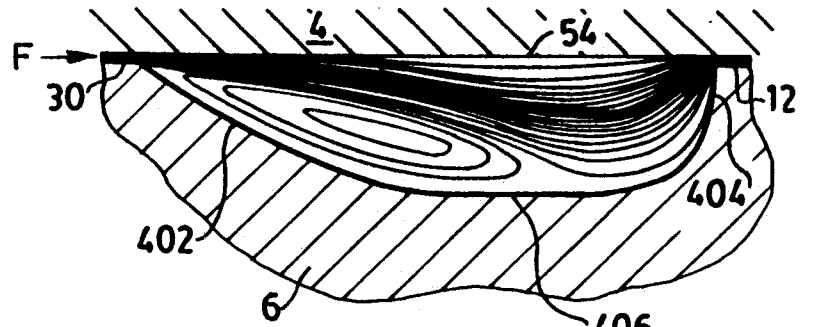

Collectively, FIGS. 4A, 4B, 4C and 4D show the flow patterns achieved for Reynolds Numbers of 0, 30, 35 and 40, respectively. As shown in FIG. 4A, at a Reynolds Number 0, there are no eddies created. When the Reynolds Number is increased to 30, as shown in FIG. 4B, there is still no eddying. Some minor eddying begins at a Reynolds Number of 35, as shown in FIG. 4C, but only when a Reynolds Number of 40 is reached, as in FIG. 4D, does any significant eddying occur. Although FIG. 4D shows eddying at a Reynolds Number of up to 40, it is possible to delay the onset of such eddying up to and beyond Reynolds Numbers of 50 by reducing the inlet expansion angle below that shown in FIG. 4D to a value of less than 25 degrees.

A comparison of FIGS. 4A to 4D with FIGS. 2A to 2D and FIGS. 3A to 3D shows that a secondary distribution channel configuration in accordance with the present invention significantly delays the onset of eddying to a far higher Reynolds Number than is possible with secondary distribution channels having either circular segment or semi-circular configurations. The secondary distribution channel of the present invention is thus able to handle fluid flows with Reynolds Numbers of up to 50.

Figure 5:
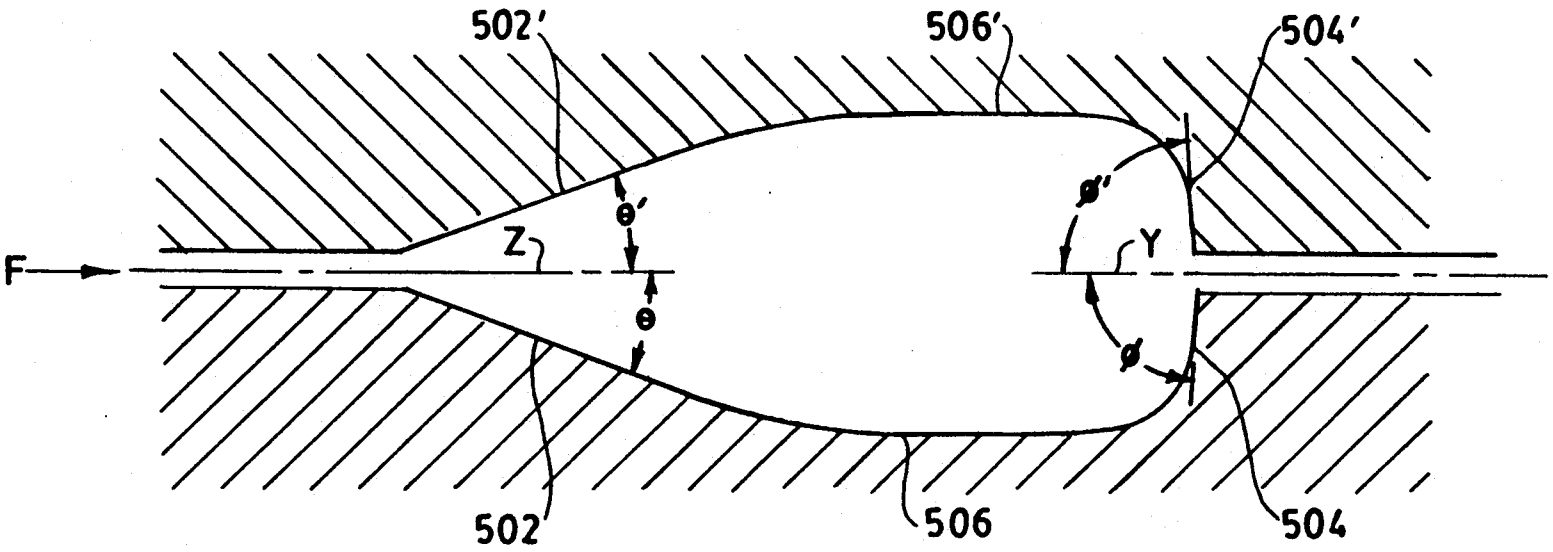
FIG. 5 is a side cross-sectional view of an alternative embodiment of a secondary distribution channel having a configuration in accordance with the present invention.

FIG. 5 is a side cross-sectional view of an alternative embodiment of a secondary distribution channel having a configuration in accordance with the present invention. In this form of the invention, the secondary distribution channel has expansion surfaces 502 and 502' extending from the inlet, and outlet contraction surfaces 504 and 504' leading to the outlet. Transition surface 506 connects surfaces 502 and 504, while transition surface 506' joins surfaces 502 and 504'. For purposes of the present invention, this embodiment of the secondary distribution channel has 2 inlet expansion angles $\theta$ and $\theta'$ and 2 outlet contraction angles $\phi$ and $\phi'$. Inlet expansion angles $\theta$ and $\theta'$ are formed between imaginary line Z and lines tangent to surfaces 502 and 502', respectively. Likewise, outlet expansion angles $\phi$ and $\phi'$ are formed between imaginary line Y and lines tangent to surfaces 504 and 504', respectively. Again, inlet expansion angles $\theta$ and $\theta'$ must be less than outlet contraction angles $\phi$ and $\phi'$, respectively. However, $\theta$ and $\theta'$ need not be equal, nor must $\phi$ and $\phi'$ be the same.

By utilizing a relatively acute inlet expansion angle and a relatively large cross-sectional area, the secondary distribution channel of the present invention is able to discharge a uniformly distributed and homogeneous photographic liquid. This results in a higher quality coated photographic film or paper. In addition, the present invention has production benefits, because the need to stop operations and purge impurities from the secondary distribution channel is substantially diminished due to its reduced eddying character. The secondary distribution channel configuration of the present invention is thus a substantial advance in photographic coating technology.

The benefits of the present invention are not, however, limited to a photographic utility. It has widespread usefulness in any application where fluid conditioning is required. For example, the fluid conditioning system of the present invention can be employed in the manufacture of magnetic oxide coatings, adhesive coatings, or other solvent coating procedures.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A fluid conditioning apparatus comprising:

conduit means positioned to carry a fluid from a source thereof;

a primary distribution channel connected to said conduit means to receive the fluid and distribute the fluid transversely;

an intermediate passage connected to said primary distribution channel at a location substantially opposed to where said conduit means is connected to said primary distribution channel;

a secondary distribution channel connected to said intermediate passage to receive the fluid from said primary distribution channel, said secondary distribution channel being configured to convey fluids having Reynolds Numbers of up to 50 without creating liquid eddies in said secondary distribution channel, wherein said secondary distribution channel has an inlet expansion angle which is less than its outlet contraction angle; and a slot connected to said secondary distribution channel at a location substantially opposed to where said intermediate passage is connected to said secondary distribution channel, said slot being adapted to withdraw the fluid, in a substantially uniform state, from said secondary distribution channel.

2. An apparatus according to claim 1, wherein said secondary distribution channel is configured to carry fluids having Reynolds Numbers up to 35 without substantial liquid eddy formation in said secondary distribution channel.

3. An apparatus according to claim 1, wherein the inlet expansion angle of said secondary distribution channel is 10° to 80°.

4. An apparatus according to claim 3, wherein the outlet contraction angle of said secondary distribution channel is 40° to 90°.

5. An apparatus according to claim 4, wherein the inlet expansion angle is 25° to 35° and the outlet contraction angle is 80° to 90°.

6. An apparatus according to claim 4, wherein a first surface of said secondary distribution channel is substantially planar and the inlet expansion angle and the outlet contraction angle are formed between the first surface and planes tangential to substantially opposed inlet and outlet walls, respectively, of said secondary distribution channel and wherein a second surface substantially in a plane parallel to the first surface connects the inlet and outlet walls.

7. An apparatus according to claim 1, wherein said secondary distribution channel has two walls expanding cross-sectionally in different directions from an inlet and two walls contracting cross-sectionally in different directions toward an outlet with substantially linear axes extending from the inlet and the outlet, wherein the angle between the inlet axis and each of the inlet walls is less than the angle between the outlet axis and each of the outlet walls.

8. An apparatus according to claim 1, wherein said primary and secondary distribution channels of said intermediate passage, and said slot are each defined in-part by a substantially planar surface.

9. A coating device adapted to apply one or more layers of photographic liquids on a web of paper or film support and including, for at least some of the photographic liquids being applied to the web, a liquid passage system comprising:

a primary distribution channel for receiving photographic liquid from a source thereof and distributing the photographic liquid transversely;

an intermediate passage connected to said primary distribution channel at a location substantially opposed to where photographic liquid entered said primary distribution channel;

a secondary distribution channel connected to said intermediate passage for receiving photographic liquid from said primary distribution channel and configured to convey photographic liquids having Reynolds Numbers of up to 50 without creating liquid eddies in said secondary distribution channel and to produce a more uniform photographic liquid, wherein said secondary distribution channel has an inlet expansion angle which is less than its outlet contraction angle; and a slot connected to said secondary distribution channel at a location substantially opposed to where said intermediate passage is connected to said secondary distribution channel and positioned to deliver the photographic liquid to a location in said coating device where a layer of the liquid is formed for application to the web.

10. An apparatus according to claim 9, wherein said secondary distribution channel is configured to carry photographic liquids having Reynolds Numbers up to 35 without substantial liquid eddy formation in said secondary distribution channel.

11. An apparatus according to claim 9, wherein the inlet expansion angle of said secondary distribution channel is 10° to 80° and the outlet contraction angle of said secondary distribution channel is 40° to 90°, wherein a first surface of said secondary distribution channel is substantially planar and the inlet expansion angle and the outlet contraction angle are formed between the first surface and substantially opposed inlet and outlet walls, respectively, of said secondary distribution channel and wherein a second surface substantially in a plane parallel to the first surface connects the inlet and outlet walls.

12. An apparatus according to claim 9, wherein the inlet expansion angle is 25° to 35° and the outlet contraction angle is 80° to 90°.

13. An apparatus according to claim 9, wherein said secondary distribution channel has two walls expanding cross-sectionally in different directions from an inlet and two walls contracting cross-sectionally in different directions toward an outlet with substantially linear axes extending from the inlet and the outlet, wherein the angle between the inlet axis and each of the inlet walls is less than the angle between the outlet axis and each of the outlet walls.

14. An apparatus according to claim 9, wherein the liquid passage means is located within said coating device.

15. A coating slide hopper adapted to apply a plurality of separate and discrete layers of photographic liquid coatings on a web of paper or film comprising:

a liquid-applying plate having an elongate planar upper surface which is inclined from horizontal and leads to an application area from which coatings can be applied to the web;

a plurality of layering plates spaced and serially-arranged with respect to each other and each having a planar upper surface inclined from horizontal with one of said layering plates being adjacent said liquid-applying plate, wherein said liquid-applying plate and said plurality of layering plates are oriented to define with their upper surfaces a substantially planar incline leading to the application area;

a coating liquid passage system between each of said plurality of layering plates and between said liquid-applying plate and its adjacent layering plate, extending to the planar incline from a substantially opposite surface of said curtain-forming plate and said plurality of layering plates, said coating liquid passage system comprising:

a primary distribution channel for receiving photographic liquid from a source thereof and distributing the photographic liquid transversely;

an intermediate passage connected to said primary distribution channel at a location substantially opposed to where the photographic liquid entered said primary distribution channel;

a secondary distribution channel connected to said intermediate passage for receiving photographic liquid from said primary distribution channel and configured to convey photographic liquids having Reynolds Numbers of up to 50 without creating liquid eddies in said secondary distribution channel and to produce a more uniform photographic liquid product, wherein said secondary distribution channel has an inlet expansion angle which is less than the outlet contraction angle; and a slot connected to said secondary distribution channel at a location substantially opposed to where said intermediate passage is connected to said secondary distribution channel and positioned to deliver the photographic liquid to the inclined planar surface at the adjacent layering plate or to said liquid-applying plate, wherein a photographic liquid passes sequentially through said primary distribution channel, said intermediate passage, said secondary distribution channel, and said slot for each of said coating liquid passage systems and on to the inclined planar surface of the adjacent layering plate or liquid-applying plate to form a layer of that photographic liquid, whereby a plurality of layers of photographic liquids builds up on the planar incline, beneath any layers formed by layering plates farther from the application area, to form a pack of discrete superimposed liquid layers which advances down the planar incline to the application area from which the pack can be applied to the web.

16. An apparatus according to claim 15, wherein said secondary distribution channel is configured to carry fluids having Reynolds Numbers up to 35 without substantial liquid eddy formation in said secondary distribution channel.

17. An apparatus according to claim 15, wherein the inlet expansion angle of said secondary distribution channel is 10° to 80° and the outlet contraction angle of said secondary distribution channel is 40° to 90°, and wherein a first surface of said secondary distribution channel is substantially planar and the inlet expansion angle and the outlet contraction angle are formed between the first surface and substantially opposed inlet and outlet walls, respectively, of said secondary distribution channel and wherein a second surface substantially in a plane parallel to the first surface connects the inlet and outlet walls.

18. An apparatus according to claim 15, wherein said secondary distribution channel has two walls expanding cross-sectionally in different directions from an inlet and two walls contracting cross-sectionally in different directions toward an outlet with substantially linear axes extending from the inlet and the outlet, wherein the angle between the inlet axis and each of the inlet walls is less than the angle between the outlet axis and each of the outlet walls.

19. An apparatus according to claim 18, wherein, for each side of the axes, the angle between the inlet axis and the inlet wall is less than the angle between the outlet axis and the outlet wall.

20. An apparatus according to claim 15, wherein the planar surfaces of said liquid-applying plate and of said layering plates together form an incline at an angle of 5 ° to 20° from horizontal.

21. An apparatus according to claim 15, wherein the slide hopper is configured so that the pack of photographic liquid layers is applied from the liquid-applying plate on to the web as a curtain with the application area being a lip portion from which the curtain falls.

* * * * *